US006062168A

United States Patent [19]

Host et al.

[11] Patent Number: 6,062,168

[45] Date of Patent: May 16, 2000

[54] SANITARY REFUSE AND ANIMAL DUNG COLLECTION VALET

[76] Inventors: Douglas R. Host, 10019 Wellington Blvd., Powell, Ohio 43065; Stephen A. Skilken, 383 S. Third St., Columbus, Ohio 43215

[21] Appl. No.: 09/159,710

[22] Filed: Sep. 24, 1998

[51] Int. Cl.[7] ..... A01K 29/00

[52] U.S. Cl. ..... 119/161; 294/1.4; 294/1.5

[58] Field of Search ..... 119/161, 867; D30/161, 162; 294/1.3, 1.4, 1.5, 53.5, 118

[56] References Cited

U.S. PATENT DOCUMENTS

| | | | |
|---|---|---|---|
| D. 240,838 | 8/1976 | Nitu . | |
| D. 292,035 | 9/1987 | Aksamit | D30/162 |
| D. 374,110 | 9/1996 | Hull et al. | D30/162 |
| D. 381,778 | 7/1997 | Semo | D30/162 |
| 3,692,347 | 9/1972 | Bixler | 294/50.8 |
| 3,778,097 | 12/1973 | Dorzan | 294/1.4 |
| 3,786,760 | 1/1974 | Pezzino | 294/1.5 |
| 3,819,220 | 6/1974 | Bredt | 294/19 R |
| 3,868,135 | 2/1975 | Magliaro | 294/1.5 |
| 3,879,079 | 4/1975 | Nicholas | 294/1.4 |
| 3,977,422 | 8/1976 | Cabaluna | 135/66 |
| 3,977,715 | 8/1976 | Casci | 294/1.4 |
| 3,986,744 | 10/1976 | Krogstad et al. | 294/1.3 |
| 4,003,595 | 1/1977 | Fano et al. | 294/19 R |
| 4,010,970 | 3/1977 | Campbell | 294/19 R |
| 4,012,067 | 3/1977 | Travis | 294/19 R |
| 4,042,269 | 8/1977 | Skermetta | 294/19 R |
| 4,047,746 | 9/1977 | Radowski | 294/1.4 |
| 4,056,278 | 11/1977 | Bau et al. | 294/19 R |
| 4,078,838 | 3/1978 | Nadratowski | 294/19 R |
| 4,121,866 | 10/1978 | Schall et al. | 294/1.4 |
| 4,136,900 | 1/1979 | Thompson | 294/19 R |
| 4,146,260 | 3/1979 | Carrington | 294/19 R |
| 4,165,895 | 8/1979 | Bacoka | 294/19 R |
| 4,191,414 | 3/1980 | Dameron | 294/1 BA |
| 4,196,928 | 4/1980 | Spangler | 294/55 |
| 4,215,887 | 8/1980 | Boots | 294/1.4 |
| 4,236,741 | 12/1980 | Emme | 294/1 BB |
| 4,253,691 | 3/1981 | Lui | 294/1 BA |

(List continued on next page.)

*Primary Examiner*—Peter M. Poon
*Assistant Examiner*—Yvonne R. Abbott
*Attorney, Agent, or Firm*—Standley & Gilcrest LLP

[57] ABSTRACT

A sanitary, portable, light weight, and hand held and actuated refuse and waste collection device, and more particularly a telescopically adjustable, refuse and animal dung collection valet configured for convenient and sanitary collection of refuse and animal waste without the need for direct user contact with the refuse or animal dung and compatible for use with readily available disposal bags. The sanitary refuse and animal dung collection valet includes a collector assembly having two tubes pivotally connected in a lever or scissors arrangement. The user grips and actuates the handles of the valet on the upper end of the tubes to scoop the waste from the ground and into a refuse collection receptacle such as a disposable bag. The bag is supported at a lower end of the valet on a support frame connected to one of the tubes and which is opposingly positioned to cooperate with a pusher paddle connected to the lower end of the other tube. When the handles are moved together, the paddle scrapes the waste along in the direction of the open bag. The open end of the bag is folded over the paddle and the frame so that the waste never contacts any surface of the valet and only side of the bag. Once the waste has been scooped into the bag, the bag is removed from the valet paddle and frame for disposal.

11 Claims, 3 Drawing Sheets

U.S. PATENT DOCUMENTS

| | | | |
|---|---|---|---|
| 4,257,635 | 3/1981 | Mainprice | 3/81 |
| 4,323,272 | 4/1982 | Fortier | 294/1 BA |
| 4,335,678 | 6/1982 | Garza et al. | 119/1 |
| 4,466,647 | 8/1984 | Spevak | 294/1 BB |
| 4,645,252 | 2/1987 | Riley | 294/1.4 |
| 4,705,310 | 11/1987 | Scripter | 294/1.4 |
| 4,717,186 | 1/1988 | Yoshioka | 294/1.5 |
| 4,852,924 | 8/1989 | Ines | 294/1.5 |
| 4,875,729 | 10/1989 | Peck | 294/1.3 |
| 4,878,703 | 11/1989 | Yoshioka | 294/1.5 |
| 4,962,956 | 10/1990 | Scripter | 294/1.4 |
| 5,039,149 | 8/1991 | Gish | 294/1.4 |
| 5,269,578 | 12/1993 | Fandrey | 294/74 |
| 5,320,393 | 6/1994 | Cortinas | 294/1.4 |
| 5,335,952 | 8/1994 | Clapper | 294/1.4 |
| 5,344,200 | 9/1994 | Yoshioka | 294/1.5 |
| 5,350,208 | 9/1994 | Heinrichson | 294/1.4 |
| 5,370,431 | 12/1994 | Henninger et al. | 294/1.3 |
| 5,634,678 | 6/1997 | Bailey | 294/1.5 |
| 5,667,264 | 9/1997 | Tanahara | 294/1.4 |
| 5,671,959 | 9/1997 | Tsou | 294/1.4 |
| 5,676,411 | 10/1997 | Kwok | 294/1.5 |
| 5,683,129 | 11/1997 | Jensen | 294/1.5 |
| 5,758,917 | 6/1998 | Langley | 294/1.5 |

SANITARY REFUSE AND ANIMAL DUNG COLLECTION VALET

BACKGROUND OF THE INVENTION

1. Field of the Invention

The present invention relates generally to sanitary, portable, hand-held, and hand-actuated waste collection devices, and more particularly to a telescopically adjustable, refuse and animal dung collection valet which is configured for convenient and sanitary collection of refuse and animal waste using readily available, disposable bags without the need for the user to either clean the collection device or to have any direct contact with the refuse or animal dung.

2. Background

The need for the collection and disposal of refuse and animal dung from public and private places has existed for as long as people have inappropriately cast off refuse or have allowed their animals to deposit dung in less than desirable places. The continuously increasing population of people and animals, especially in urban and suburban communities has increased the demand for improved sanitary collection devices for capturing refuse and animal dung. Various types of hand held and operated, portable refuse and animal dung collection devices are known which facilitate collection and disposal of such waste. Some types of devices are adapted to catch dung as it is deposited, while other types are designed to scoop up refuse and dung from the ground.

Such waste collection devices come in various configurations which may include a single elongated pole with an actuator handle at one end and a scoop or other kind of capture mechanism at the opposite, lower end. The capture mechanism in certain devices includes a disposable bag with an open end which is placed on the ground near the waste to be collected. In some configurations, the open end of the bag may also be placed beneath the rump of the animal to collect the waste before it reaches the ground. In other configurations, the waste is scooped from the ground into the bag either (1) by use of an accompanying second component or implement, such as a rake or similar device, or (2) by dragging the open end of the bag along the ground in an often unsuccessful attempt to scoop the refuse or dung into the bag.

In yet other adaptations of a single piece collection device, the scoop mechanism of the device includes a hinged paddle member connected adjacent to the open end of the bag. The paddle is nominally biased in a closed position against the open end of the bag. Using a lever or similar mechanism located on the upper handle of the collector pole, the paddle is actuated to an open position and the scoop mechanism is placed with the paddle on one side of the refuse and the open end of the refuse collection container on the other side of the refuse. The lever is actuated again to move the paddle toward the open end of the bag and, ideally, although often unsuccessfully, urge the refuse into the bag. Some collection device configurations incorporate a disposable collection container or cartridge which is adapted to be removed from the collector device and cleaned or disposed of and replaced with a new container after the refuse or animal dung is collected.

Additionally, attempts have been made in the past to configure the collector bag or cartridge supporting hardware so that the bag may cover certain components of the collector device so that elements of the device do not become soiled or contaminated by coming into direct contact with the refuse or animal waste. However, all such devices have significant disadvantages and drawbacks because they either fail to adequately protect such components from contamination, or because they require use of custom-designed refuse collection collectors, containers, or bags. Since no particular standard refuse collector container size is prevalent in the marketplace, a user is put to considerable expense and inconvenience to obtain replacement refuse collectors for the collection device. Alternatively, the user is forced to discard the device and purchase a different device for which replacement containers are available. In addition to these problems, such devices also suffer from the disadvantage that they are unnecessarily heavy to carry and are too cumbersome to efficiently clean, maintain, and use. Other complicated modifications to collection devices have been suggested which are directed to automating the opening, closing, releasing, and disposal of the collector bag using a single handed actuator. Such complicated mechanisms, included those employed to enable the scoop or capture mechanisms to collect refuse, create added fabrication costs and undesirable component failure modes due to the increased number of moving and complex parts.

Even though various types of refuse and animal dung collectors and scoopers have been known for some time, many shortcomings persist in the field of art and many desirable characteristics and needed capabilities are absent, especially with respect to: (1) reducing manufacturing costs, (2) device complexity, and (3) increasing compatibility of the devices for use by individuals of various heights and for use with widely available, disposable refuse collectors, containers, and bags, and (4) preventing contamination of the user and the collection device during use. Presently known devices usually require custom-design bags and are unnecessarily expensive to manufacture. They disadvantageously incorporate a myriad of components and mechanisms which are prone to failure from repeated, ordinary use and the collection devices are difficult to protect from contamination, and to clean and maintain.

What is needed is an easy to use, inexpensive to manufacture apparatus for efficiently collecting refuse and animal dung without the need for complicated mechanisms, custom-sized refuse collection bags, cleaning of the collector components, and which is compatible for use by people of various heights. More specifically, what is needed and heretofore unavailable is a light weight, hand-held, portable and sanitary refuse and animal dung collection device which is simple in construction and straightforward to use, and which requires minimal effort and inconvenience on the part of the user to (1) collect refuse and animal waste without contaminating or soiling any components of the collection valet, (2) remove used, soiled, and contaminated collection bags without contacting the refuse or animal waste, and (3) install new, clean bags on the collection device while avoiding any contact with the refuse or animal waste.

Ideally, the preferred sanitary refuse and animal dung collection valet should be compatible for use with a wide variety of commonly available refuse collectors, containers and/or cartridges including, for example, the flexible plastic bags commercially available and/or provided to customers of nearly every department and grocery store. Additional features of a useful waste collection device should also allow the user to adjust the length of the refuse and dung collection valet and collapse the valet into a small, compact package for easy and convenient transport.

SUMMARY OF THE INVENTION

The present invention provides a sanitary refuse and animal dung collection valet incorporating an efficient two-piece design which greatly facilitates collection of refuse and animal dung. The collection valet incorporates a collector assembly including an elongated frame support tube which is pivotally connected in a lever arrangement to an elongated pusher tube. Each tube includes a gripped handle at an upper end. The frame support tube includes a refuse collector, container, or bag support frame or chassis at its opposite, lower end for supporting the refuse collection container, which is, for example, a flexible paper or plastic bag. The pusher tube includes a generally planar pusher paddle or scraper plate mounted at its lower end. A pivot or swivel hinge assembly, for example without limitation, a pivot pin, pivotally connects the two tubes so that the paddle and support frame or chassis move towards one another as the handles are moved together. The refuse collector, container, or bag support frame or chassis forms a centrally positioned interior opening. The paddle is opposingly positioned to the bag support frame and, when the handles are actuated in a direction towards each other, it cooperates with the frame and pushes the waste towards the bag support frame.

The collection valet invention also preferably includes a plurality of refuse collector retainers or hooks formed in or mounted to each of the tubes which are adapted to retain the refuse collector, such as, for purposes of illustration and not limitation, a plastic container or bag, to the collector assembly while the collection valet is in use. The collector assembly further includes a refuse collector, such as a disposable bag, formed with a closed end and an opposite open end. The open end is formed with first and second handle cover portions which extend outward from a peripheral margin surrounding the open end of the refuse collector. The closed end of the collector or bag is passed through the interior opening of the bag support frame so that the open end is between the bag support frame and the paddle. To prevent soiling and contamination of the collector assembly, the first handle portion is folded over the bag support frame to cover it completely. Similarly, the second handle portion is folded over to completely cover the paddle. Both handle cover portions thereby protect the components of the collector assembly from soiling and contamination and are retained in place by the collector retainers. After use, the handle cover portions are disconnected from the retainers and the refuse collector is removed from the collection valet for disposal.

The present invention preferably includes a telescopic adjuster mechanism formed in the approximate middle portion of each of the tubes. When the mechanisms are actuated, the handle segment of each tube may be telescopically adjusted with respect to the lower segment of the tube so that the collection valet may be adjusted to a convenient length which is comfortable for use with those of average height as well as short and tall users.

The invention also preferably includes an adjustable strap adapted for carrying the collection valet and a spare refuse collector holder for carrying additional collectors such as plastic or paper bags.

Other features and advantages of the invention will become apparent from the following detailed description, taken in conjunction with the accompanying drawings, which illustrate, by way of example, the features of the present invention.

BRIEF DESCRIPTION OF THE DRAWINGS

Without limiting the scope of the present invention as claimed below and referring now to the drawings, wherein like reference numerals across the several views refer to identical, corresponding or equivalent parts:

DETAILED DESCRIPTION OF THE PREFERRED EMBODIMENT(S)

Users of various types of hand-held, portable waste collection devices have long been challenged by the need to collect refuse and, for example, animal waste, in a sanitary manner without the need for direct user or device component contact with the refuse and waste and cleaning of the device components after each use. Although various types of such devices are known or available for use, each type presents its own peculiar complexities, problems, and inadequacies. Such difficulties presently include soiling and contamination of devices with each use, inability of devices to easily capture and discard waste, incompatibility of devices for use with individuals of various heights, unwieldiness of presently available devices, unavailability of devices which are inexpensive and which incorporate a minimum number of mechanisms, and the incompatibility of devices for use with readily available waste and refuse collectors, such as widely available plastic bags. What has been needed and as yet unavailable is a hand-held and portable waste collection device which overcomes these many serious difficulties, is inexpensive to manufacture, and easy to use, maintain, and protect from contamination.

The hand-held, portable refuse and animal dung collection valet embodying the present invention provides a new and cost effective means for reducing such difficulties and inconveniences. Such improvements to the art are accomplished with the present invention which uses a minimum number of optimized components to easily capture otherwise difficult to collect refuse and animal waste without contaminating or soiling any components of the collection valet in a sanitary manner and without the need for the user to directly contact such refuse or waste. The present invention also incorporates features which facilitate convenient and sanitary removal and replacement of used, soiled, or otherwise contaminated collection bags, also without any contact with the refuse or waste. The sanitary refuse and animal waste collection valet embodying the present invention is also compatible with a large number of readily available waste collectors including commercially available bags such as, for example, off-the-shelf disposable trash bags and the disposable bags provided to nearly every customer of most grocery and department stores. Additionally, the present invention also incorporates the capability for simplified telescopic adjustment of the length of the collection valet which provides compatibility for use by individuals of various heights, while also maintaining the capability to collapse the device into a small, compact form for easy and convenient carrying and storage.

Figure 1:
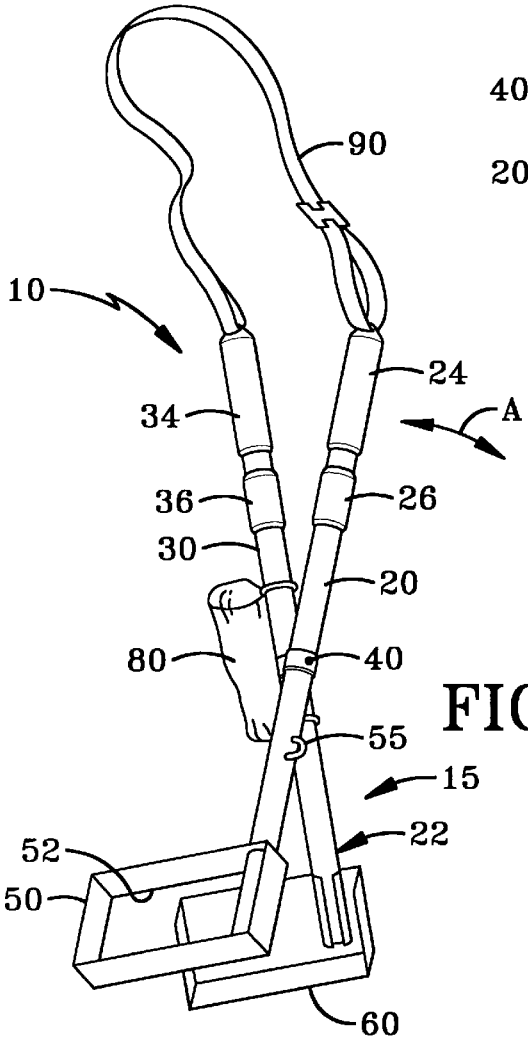
FIG. 1 depicts an elevated perspective view, in reduced scale, of a telescopically adjustable refuse and animal dung collection valet of a preferred embodiment of the present invention.
Figure 2:
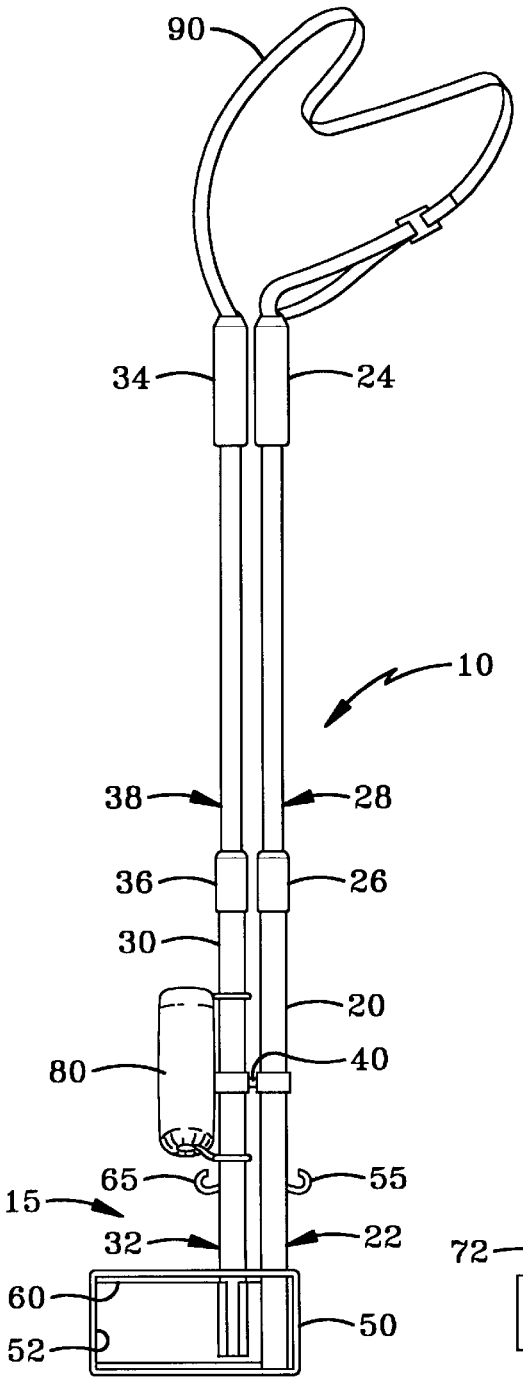
FIG. 2 depicts a planform view, in reduced scale, of the collection valet of FIG. 1.

As can be understood with reference to FIGS. 1 and 2, the present invention is a refuse and animal dung collection valet designated generally by reference numeral 10. A preferred embodiment of the collection valet 10 incorporates a collector assembly 15 including a light weight, elongated frame or chassis support tube 20. The frame support tube 20 has a lower frame end 22 opposite a first upper handle grip 24. The collector assembly 15 also includes an elongated, light weight pusher or paddle tube 30 formed with a lower paddle end 32 opposite a second upper handle grip 34. The pusher tube 30 is pivotally connected in a lever relationship to the support tube 20 with a pivot or hinge mechanism such as, for purposes of illustration and not limitation, a pivoting assembly. In a preferred embodiment of the invention, the pivoting or hinging assembly is a pivot pin 40 positioned to connect the support tube 20 and the pusher tube 30 at a point approximately closer to the frame end 22 and the pusher end 32 in an arrangement similar to, for example, a pair of pliers or scissors. Although, the various drawings reflect tubes having a cylindrical configuration, many possible cross-sections are equally suitable for use with and contemplated by the present invention.

The collector assembly 15 preferably includes a bag support frame or chassis 50 which is connected to the lower frame support end 22 of the support tube 20. The bag support frame 50 is formed with a generally central interior opening 52. Although the bag support frame 50 is schematically represented across the several views as being of a generally rectangular shape, any number of equally suitable geometric configurations exist. The collector assembly 15 also includes a pusher paddle or scraper plate 60 connected to the lower paddle end 32 of the pusher tube 30. The pusher paddle 60 is shown across the several figures to have a generally rectangular shape which is preferably similar in design to the bag support frame 50. However, the paddle 60 may be formed to have any of a number of equally suitable but different shapes which will have dimensions which preferably approximately correspond with the shape of the interior opening 52 of the bag support frame 50.

Figure 3:
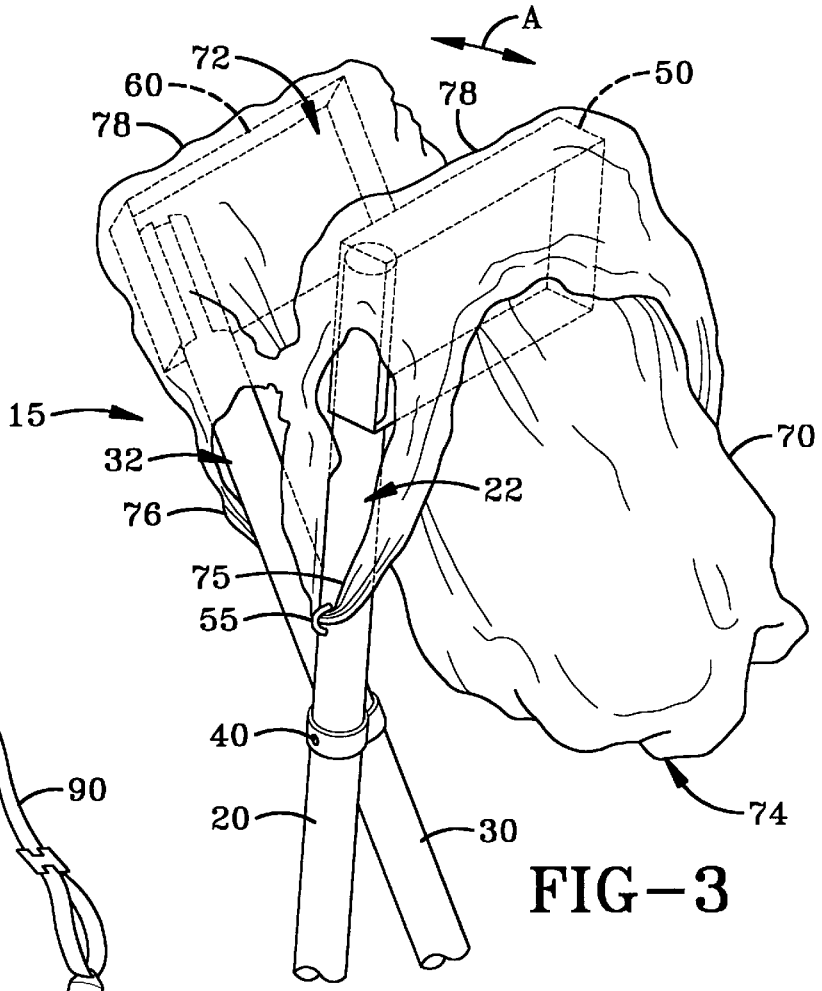
FIG. 3 is an elevated, partial perspective view, in enlarged scale, of the collector assembly of the collection valet of FIG. 1.
Figure 4:
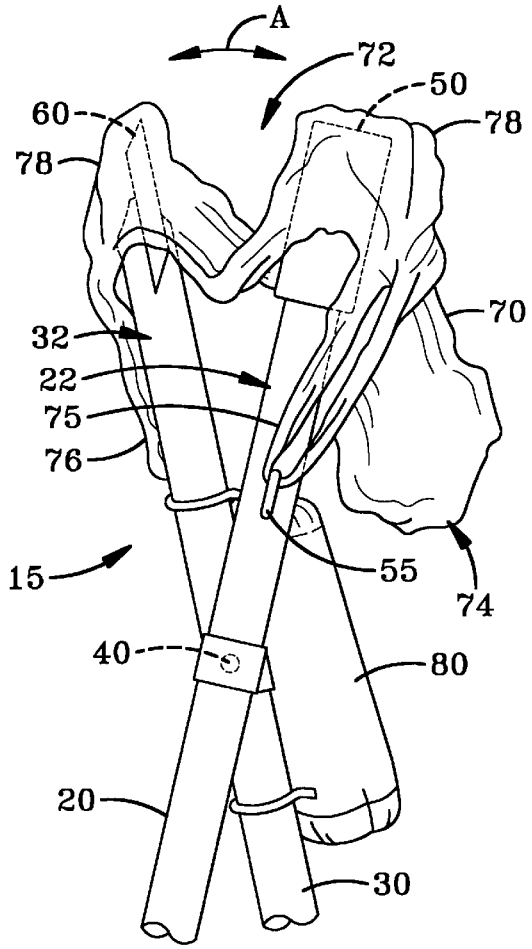
FIG. 4 is a partial side view, in enlarged scale of the collection valet of FIG. 3.
Figure 5:
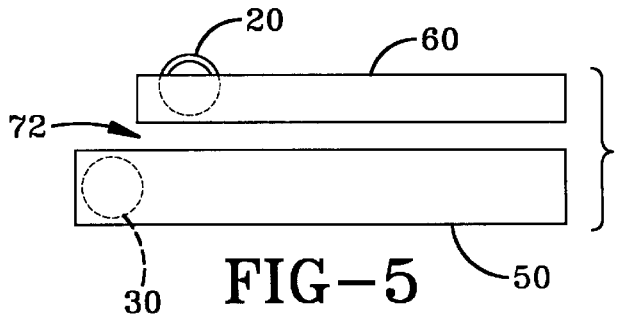
FIG. 5 is a partial bottom view, in enlarged scale and with certain structure removed for illustration purposes, of the collector assembly of the valet of FIG. 1.
Figure 6:
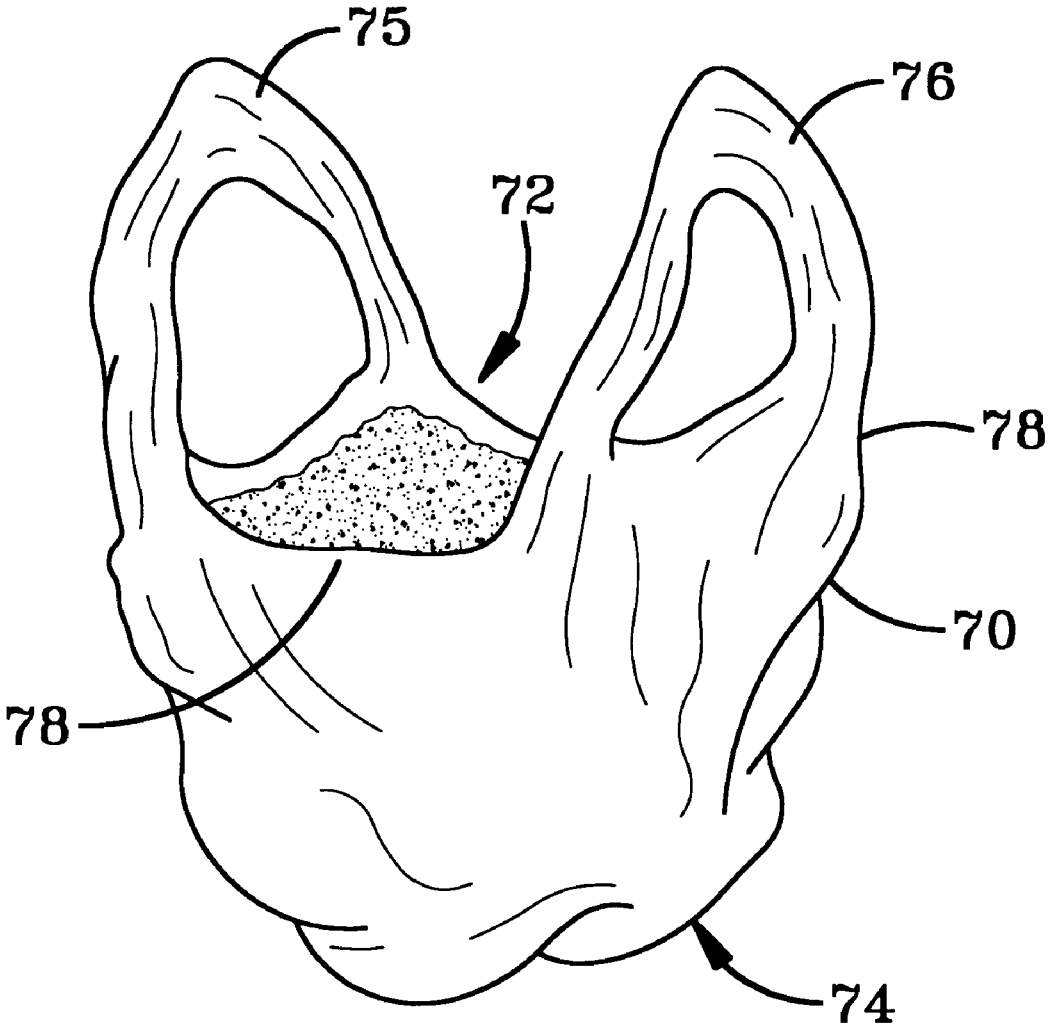
FIG. 6 is a perspective view, in reduced scale, of the uninstalled refuse collector, container, or bag depicted in FIGS. 3 and 4.

As can be understood with continued reference to FIGS. 1, 2, and 5, the paddle 60 is positioned so one of its generally planar or flat faces is oriented to be orthogonal to the central axis of the opposingly positioned interior opening 52 of the bag support frame 50. In this orientation, the paddle 60 is positioned to scrape or push the targeted waste into a bag supported on the frame 50 and the paddle 60 as the handles 24 and 34 are moved closer to one another. The position of the pivot assembly is configured to establish a range of motion sufficient to move the paddle and frame apart and together to capture the refuse or waste targeted for disposal as the handles 24 and 34 are actuated in the direction described by arrows "A" in FIGS. 3 and 4.

With reference to FIGS. 2, 3, 4, and 6, it can be recognized that the support tube 20 and the pusher tube 30 each include a first retainer 55 and a second retainer 65, respectively. In the preferred embodiment, the retainers 55, 65 are formed to retain a refuse collector 70, such as, for example but not limitation, a disposable, flexible container 70 as described in more detail below. The retainers 55, 65 are, more preferably, hooks which are adapted to releasably or detachably engage a portion of the disposable bag 70 for retaining the bag 70 in place during use of the collection valet 10.

The collector assembly 15 of the present invention also includes the refuse collector 70, which is preferably a disposable, flexible container adapted to fold over to completely cover the bag support frame 50 and the pusher paddle 60 when retained by the retainers 55, 65. More preferably, the refuse collector 70 is a disposable plastic bag configured with a central open end 72, an opposite closed end 74, and first and second handle cover portions 75 and 76, respectively, which depends outwardly from a peripheral margin 78 surrounding the central opening 72. The plastic bag can be any of wide variety of off-the-shelf, commercially available bags intended for use with small to medium sized trash receptacles. Such bags may include those having handle cover portions such as the various sizes of "Handle-Tie" type, Glad™ brand trash bags available from The First Brands Corporation. However, although described as suited for use with the preferred embodiment, handles on a bag 70 are not required for the collector, container, or bag 70 to be compatible for use with the preferred embodiment of the collection valet 10. The disposable and flexible plastic bags, and in some cases paper bags, supplied to customers of many grocery and department stores are equally suitable for purposes of use with the present invention. Certain types of such bags are typically formed with dual handles and are suitable for use with the present invention.

The body of the bag 70 is preferably capable of being inserted or passed through the central, interior opening 52 of the bag support frame 50. The first handle cover 75 and proximal peripheral margin 78 portion is folded over the bag support frame 50 so the handle cover and margin portion of the bag 70 completely covers the bag support frame 50. The first handle cover portion 75 is then releasably or detachably engaged with the first retainer 55. Similarly, the second handle cover 76 and peripheral margin 78 portion is folded over the pusher paddle so the handle cover and margin portion of the bag 70 completely covers the pusher paddle or scraper plate 60. The second handle cover portion 76 is then releasably or detachably engaged with the second retainer 65. As installed and retained in place, the opening 72 of the bag 70 is positioned directly between the bag support frame 50 and the paddle 60 such that the opening 72 is preferably directed downwards towards the ground during use. In this preferable configuration, the refuse or waste will directly contact only the interior of the refuse collector, container, or bag 70 and may be captured within the bag 70 by the collection valet 10 so that the debris will not soil or contaminate either the user or any component of the collector assembly 15.

In a variation of a preferred embodiment of the present invention, collars 26 and 36 may be incorporated at intermediate positions between the lower ends 22, 32 and the upper handle grips 24, 34, respectively. Telescopic adjusters may be connected to the respective ends of the a upper segments 28, 38 of the tubes 20 and 30 that are closest to the lower ends 22, 32 such that upper and lower segments of the respective tubes 20 and 30 are telescopically adjustable relative to each other. The adjusters may be configured to be actuatable either by a rotation or sliding motion, or other equally effective actuation means with respect to the tubes. Such actuation adjusts or enables adjustment of the length of the tubes 20 and 30. Also, the adjusters may be actuatable so the tubes may be collapsed to a minimum length and compact the collection valet to facilitate convenient storage and carrying.

In another variation of a preferred embodiment, the upper segments 28, 38 may be adapted with threaded elements at the ends opposite of the grips which are engaged with and connected to the lower segments of the respective tubes 20, 30 which are rotatable relative to the tubes 20, 30 such that rotation may telescopically lengthen, shorten, and lock/fix the overall length of the collection valet 10. Alternatively, the upper segments 28, 38 may be rotatable or slidable in relation to the lower ends 22, 32 to loosen and tighten utilizing a friction or a press-fit joint element adapted to enable telescopic adjustment of the upper and lower segments of the respective tubes 20, 30 for purposes of adjusting the overall length of the valet 10. Other related variations of the adjusters contemplated by the present invention include various types of frictional adjuster joint elements known to the art which are adapted to enable adjustment of the length of the collection valet 10.

Other variations of the preferred embodiment incorporate a spare refuse collector bag holder 80 attached to at least one of the tubes 20 and 30. A carrying or shoulder strap 90 may be incorporated in yet additional variations of the present invention for transporting the collection valet 10 before and after use. Also contemplated as a modification to the preferred embodiment of the present invention, a torque spring assembly, not shown but known to the art, is added to the pivot or hinge assembly to bias the tubes 20 and 30 so the frame 50 and the paddle 60 are biased either towards or away from one another. If the tubes 20 and 30 are biased so the frame 50 and the paddle 60 are forced together, then the user actuates the handles 24 and 34 together to overcome the force of the bias spring to move the frame 50 and the paddle 60 apart to capture the targeted waste. Each of these particular variations are contemplated for use either alone or in combination with any of the previously described variations or modifications to the preferred embodiment.

In operation, the refuse and animal dung collection valet 10 may be adjusted by the user to establish a comfortable operating length. Next, the user removes a new, clean bag 70 from the storage holder 80 and installs the bag 70 onto the collector assembly 15. The body of the bag 70 is threaded through the central, interior opening 52 of the bag support frame 50 with the closed end 74 directed away from the paddle 60 and the opening 72 positioned between the support frame 50 and the paddle 60. The user then folds the first handle cover 75 and proximal peripheral margin 78 portion over the bag support frame 50 to completely cover the frame and detachably retains the end of the handle portion 75 in the retainer 55. The second handle cover 76 and proximal peripheral margin 78 portion is folded over to completely cover the pusher paddle or scraper plate 60 and the end of the second handle 76 is releasably retained by the retainer 65. Once the bag 70 is installed and retained in position, the open end 72 of the bag is configured for the capture of refuse and waste without any direct contact of the collector assembly 15 or user with the contaminating trash or waste.

The user employs the collection valet 10 of the present invention to capture refuse and waste targeted for removal in any of at least three various modes or methods of operation. In the first mode, the valet 10 may be used with a single hand as a receptacle to capture animal dung as it is deposited by the animal. To accomplish this objective, the open end 72 is situated beneath the rump of the animal so the dung is received into the bag 70 before being deposited on the ground. In a second method of operation, the collection valet 10 is used either single-handedly, or using both hands, as a scoop where the used places the lower most portion of the bag support frame 50 against the ground and drags or scrapes the support frame 50 of the collector assembly 15 along the ground to "scoop" the refuse or waste into the bag 70. In a third, two handed mode, the handle grips 24 and 34 of valet 10 are actuated, in the directions described by arrows "A", to move apart the bag support frame 50 and the paddle 60 in preparation to capture the refuse within the bag 70. The user then places the collector assembly 15 with the paddle 60 on one side of the targeted waste and the bag support frame 50 on the other side so the opening 72 of the bag 70 encloses the waste. Next, the user actuates the handle grips 24 and 34 together to "push" or "scrape" the waste into the bag 70. The third mode is particularly well-designed for difficult refuse collection situations which are otherwise unsuitable for previously described modes of operation. Each of the described modes, as well as other obvious yet undescribed modes of operation, may be used either alone or in combination with each of the other modes. For example, a preferred embodiment of the present invention may be used multiple times with a single bag.

After the collection valet 10 has captured the targeted refuse or waste within the bag 70, the bag is easily removed without contacting the debris by simply detaching or releasing the handle cover portions 75 and 76 from the respective retainer hooks 55 and 65. The bag 70 is then easily removed from the frame 50 of the collector assembly 15 by pulling the body of the bag 70 from the bag support frame 50. As the clean handle cover portions 75 and 76 are released from the retainers, the handle cover portions 75, 76 and proximal peripheral margin portions 78 are unfolded so their contaminated and soiled interior surfaces remain on the interior of the bag 70 while the support frame 50 and the paddle 60 are uncovered. The soiled and contaminated bag 70 is then conveniently disposed of without the user or any component of the collector assembly 15 having any direct contact with the refuse or waste. As can be appreciated, all components of the sanitary collection valet 10 remain unsoiled and uncontaminated and the valet 10 is ready for storage, transport, and/or installation of a clean bag 70 and immediate reuse. The tubes 20 and 30 may thereafter be collapsed to minimize the length of the valet 10 for easy and convenient storage or carrying.

From the foregoing, it will be appreciated that the present invention provides a simple apparatus for improving ease of use and maintenance and for reducing the cost to manufacture a portable, hand-held refuse collection device. The apparatus of the present invention is simple to use, inexpensive to manufacture, and appeals to a large cross section of potential users, especially those in urban and suburban areas with pets.

The present invention therefore fulfills a real but heretofore unmet need for an inexpensive, sanitary, and easy to use and maintain, refuse and waste collection device. While particular preferred embodiments of the invention have been illustrated and described, various modifications can be made without departing from the spirit and scope of the invention, and all such modifications and equivalents are intended to be covered and claimed.

What is claimed is:

1. A sanitary animal dung collection valet, comprising:

a collector assembly including an elongated frame support tube with a frame end opposite a first grip and pivotally attached with a pivot member in a lever relationship to an elongated pusher tube having a paddle end opposite a second grip;

a bag support frame formed with an interior opening and connected to the frame end of said support tube and a generally planar pusher paddle connected to the paddle end of said pusher tube, said pusher paddle opposingly positioned to cooperate with said bag support frame to push the dung towards said bag support frame as said first and second grips are moved towards each other;

a first retainer formed in the frame end of said support tube and a second retainer formed in the paddle end of said pusher tube;

a disposable bag formed with a closed end and an opposite open end having a first and a second handle portion extending outward from a peripheral margin of said open end;

wherein said closed end is adapted to pass through the interior opening of said bag support frame; and wherein said first handle portion is configured to fold over and cover said bag support frame and is retained by said first retainer and said second handle portion is adapted to fold over and cover said paddle and is retained by said second retainer such that the open end of said bag is positioned between said paddle and said frame.

2. A sanitary animal dung collection valet according to claim 1, wherein the first and second retainers are hooks adapted to retain the first and second handle portions, respectively.

3. A sanitary animal dung collection valet according to claim 2, wherein said first and second handle portions are generally in the form of loops that define interior recesses adapted for gripping by a user.

4. A sanitary animal dung collection valet according to claim 1, further comprising telescopic adjusters connected to said frame support and pusher tubes, said telescopic adjusters adapted to adjust the length of respective said tubes.

5. A sanitary animal dung collection valet according to claim 1, further comprising a spare bag holder attached to said collector assembly.

6. A sanitary animal dung collection valet according to claim 1, further comprising a carrying strap connected at opposite ends to said collector assembly.

7. A sanitary animal dung collection valet according to claim 1, wherein said pivot member includes a torque spring assembly adapted to bias said frame towards said paddle.

8. A sanitary refuse collection valet, comprising:

a chassis support tube with a support end opposite a first handle and pivotally attached with a hinge member in a scissors relationship to a scraper tube having a scraper end opposite a second handle wherein said hinge member is positioned between the respective said ends and handles;

a first hook mounted on said chassis support tube and a second hook mounted on said scraper tube;

a refuse collector support chassis formed with a central opening and connected to the support end of said chassis support tube and a scraper plate connected to the scraper end of said scraper tube and opposingly positioned proximate to said refuse collector support chassis to scrape the refuse towards said refuse collector support chassis as said first and second handles are moved towards each other; and a disposable refuse collector formed with an open end having a first and a second cover portion depending outwardly from a margin surrounding said open end of said collector.

9. A sanitary refuse collection valet according to claim 8, wherein said refuse collector is held within said central opening with said first cover portion folded over said refuse collector support chassis and retained by said first hook and said second cover portion folded over said scraper plate and retained by said second hook with said open end of said refuse collector positioned between said support chassis and said scraper plate.

10. A refuse collector, comprising:

a collector assembly including a frame support tube having a bag support frame formed with an interior opening and the frame support tube pivotally attached to a pusher tube formed with a pusher paddle and wherein the pusher paddle is arranged to cooperate with the bag support frame to push refuse towards the bag support frame;

a first retainer formed proximate to the bag support frame and a second retainer formed proximate to the pusher paddle;

wherein the interior opening of the bag support frame is adapted to receive a closed end of a disposable bag formed with an opposite open end having a first and a second handle portion extending outward from a peripheral margin of the open end; and wherein the first handle portion is configured to fold over and cover the bag support frame and is retained by the first retainer and the second handle portion is adapted to fold over and cover the pusher paddle and is retained by the second retainer whereby the open end of the bag is positioned between the paddle and the frame to collect the refuse within the bag.

11. A refuse collector, comprising:

a collector assembly including a frame support tube having a bag support frame formed with an interior opening and the frame support tube pivotally attached to a pusher tube formed with a pusher paddle and wherein the pusher paddle is arranged to cooperate with the bag support frame to push refuse towards the bag support frame;

a first retainer formed proximate to the bag support frame and a second retainer formed proximate to the pusher paddle;

wherein the interior opening of the bag support frame is adapted to receive a closed end of a disposable bag formed with an opposite open end having a peripheral margin formed with first and second handle portions; and wherein the first handle portion is configured to fold over and cover the bag support frame and is retained by the first retainer and the second handle portion is adapted to fold over and cover the pusher paddle and is retained by the second retainer whereby the open end of the bag is positioned between the paddle and the frame to collect the refuse within the bag.

* * * * *

UNITED STATES PATENT AND TRADEMARK OFFICE

CERTIFICATE OF CORRECTION

PATENT NO. : 6,062,168
DATED : May 16, 2000
INVENTOR(S) : Douglas R. Host, et. al.

It is certified that error appears in the above-indentified patent and that said Letters Patent is hereby corrected as shown below:

In column 6, line 51, please delete the word "a".

In column 6, line 61, after the word valet, please insert the numeral -- 10 --.

Signed and Sealed this

Twentieth Day of March, 2001

Nicholas P. Godici

*Attest:*

NICHOLAS P. GODICI

*Attesting Officer*

*Acting Director of the United States Patent and Trademark Office*